United States Patent [19]

Vollhardt et al.

[11] Patent Number: 4,831,969

[45] Date of Patent: May 23, 1989

[54] PROCESS AND A DEVICE FOR CLEANING INNER OR OUTER WALLS OF VERTICALLY EXTENDING OR INVERTED TUBES OF HEAT EXCHANGERS

[75] Inventors: Frohmut Vollhardt, Oberhausen; Hans Kramer, Dinslaken, both of Fed. Rep. of Germany

[73] Assignee: Man Gutehoffnungshuette GmbH, Fed. Rep. of Germany

[21] Appl. No.: 68,887

[22] Filed: Jun. 29, 1987

[30] Foreign Application Priority Data

Jun. 30, 1986 [DE] Fed. Rep. of Germany ..... 3621850
Sep. 29, 1986 [DE] Fed. Rep. of Germany ..... 3632982

[51] Int. Cl.[4] ..... F22B 37/18; F22B 37/48

[52] U.S. Cl. ..... 122/379; 165/84; 165/95

[58] Field of Search ..... 165/84, 95; 122/379

[56] References Cited

U.S. PATENT DOCUMENTS 1,501,646 7/1924 Brown ..... 165/84 X
3,721,217 3/1973 Willach et al. ..... 165/84 X
3,971,343 7/1976 Ulrich et al. ..... 165/84 X
4,018,267 4/1977 Tomasicchio ..... 165/84
4,497,282 2/1985 Neundorfer ..... 165/84 X

*Primary Examiner*—Edward G. Favors
*Attorney, Agent, or Firm*—McGlew & Tuttle

[57] ABSTRACT

A process and a device for cleaning inner or outer walls of vertically extending or inverted tubes of heat exchangers and especially for cleaning tubes in trash incinerators. The process involves imparting kinetic energy to the tubes in an axial direction and then suddenly stopping the tubes to shake loose dirt and the like. The device for the process includes arranging a plurality of rows of vertically extending tubes such that the tubes move upwardly and downwardly in the direction of the axis of the tubes. The tubes advantageously include their own lower distributors and upper headers. These distributors and/or headers rest on a movable cam or cam plate which, for example, may be rotated so that a radially extending offset of the shoulder of the cam permits the cam to lift the upper headers upwardly to a height at which point they are suddenly dropped. In an alternative embodiment, the upper header tubes are raised or lifted at their ends by a pneumatic or hydraulic piston cylinder, and the tubes are then lowered by the acceleration of gravity.

12 Claims, 5 Drawing Sheets

PROCESS AND A DEVICE FOR CLEANING INNER OR OUTER WALLS OF VERTICALLY EXTENDING OR INVERTED TUBES OF HEAT EXCHANGERS

FIELD AND BACKGROUND OF THE INVENTION

This invention relates in general to the construction of heat exchangers and similar devices and in particular to a new and useful device for transferring heat through rows of tubes which have upper and lower headers and which extends vertically which includes means for shifting upwardly and downwardly so as to permit a falling motion and a sudden stopping thereof.

SUMMARY OF THE INVENTION

Known processes nd devices for cleaning the outer wall of upright or inverted tubes of heat exchangers provide for manual or mechanical cleaning of the heating surfaces of the tubes to remove clinging dirt particles. Such measures are particularly necessary for tubes of trash incinerators. Cleaning devices that may be mentioned includes those with brushes, beaters, and balls that are swung against the tubes, which is possible even during the operation of the exchangers, while in the case manual cleaning of the pipes, the physical exertion of the operator is substantial. When using mechanical means of cleaning, the amount of gas is changed during the cleaning process itself, so that the following gas purification and neutralization devices are impaired in the mode of action.

The purpose of this invention is to avoid manual labor and to provide the capability of carrying out the cleaning process during the operation of the heat exchanger without thereby disturbing the mode of action of the following cleaning and neutralization devices. In particular, however, uniform cleaning should occur over the length of the tubes, by which a uniform thermal stress of the tubes over their length can be achieved. The process is to be usable without fundamental modification for both the outer wall and the inner wall of tubes.

The fundamental concept underlying the process pursuant to the invention and its device is to cause the particles adhering to the tubes or in the tubes to jump off because the tubes, which initially have kinematic energy in the longitudinal direction, i.e., they have been given a longitudinal motion are abruptly stopped. This method of cleaning is particularly beneficial when the bottom end of the tube strikes a stationary stop.

Further embodiments of the invention provide as alternatives that the upper header tubes are lifted at their end by pneumatic or hydraulic piston cylinder units connected to one another under control, or are lifted and accelerated by gravity during the lowering.

This invention particularly concerns a process for cleaning the inner or outer walls of upright or inverted tubes of heat exchangers and it also concerns a device for implementing the process.

Accordingly, it is the object of the invention to provide a process for cleaning the tubes of heat exchanger which comprisse imparting or connect energy to the tubes in a longitudinal direction and then suddenly stopping them. A further object of the invention is to provide an appratus for affecting the cleaning of tubes of heat exchangers which comprises arranging the tubes in vertical rows in a manifest that the entire rows may move in the axel direction of the tubes and supporting the tubes so that they may be raised and lowered roughly.

A further object of the invention is to provide a heat exchanger which is simple in design and rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodimentt of the invention is illustrated.

DESCRIPTION OF THE PREFERRED EMBODIMENTS

Figure 1:
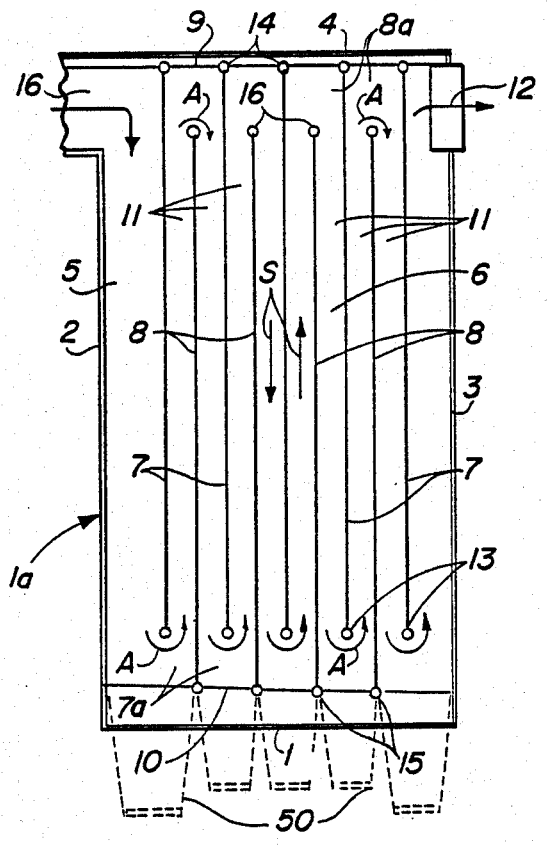
FIG. 1 is a schematic cross section through a heat exchanger with inverted finned tubes, with the tubes at the same height forming a tube wall so that the flue gases are conducted in a meandering path through the exchanger.

Referring to the drawings in particular, the invention embodied therein comprises the process for cleaning the inner and outer tubes of it vertically arranged rows in a heat exchanger such as a trash incinerator or a wasted boiler following a trash incinerator generally designated 1*a* which has a heating gas inlet 1*d* in a discharge 12.

FIG. 1 shows a waste heat boiler following a trash incinerator, as disclosed by German Pat. No. 23 41 444. This waste boiler has a bottom 1 and the two front and back walls 2, 3, as well as a cover 4 and the side walls 5.

Tubes 7 and 8 are suspended in the interior 6 of the boiler, which are designed in the present case as finned tubes, with the longitudinal edges of the finned tubes being connected to one another so that the adjacent tubes 7 and 8 in each case form a wall of finned tubes. The tubes 8 are displaced downward from the tubes 7 in the longitudinal direction, so that respective intermediate spaces 7*a* and 8*a* are produced in each case at the upper end of the tube 8, and its fins; and at the lower end of the tube 7 and its fins. This can be bounded by suitable walls 9 and 10, or otherwise. The flue gases therefore flow in the direction of the arrows A and follow a meandering course, with the flue gases flowing through the gaps 11 formed between the walls of finned tubes 7 and 8. The flue gas leaves the boiler at 12.

Instead of the finned tubes, other types of tubes can also be provided with a different arrangement and with different flow of the gases entraining the clinging particles, for example, individual tubes that are suspended in the interior 6 of the boiler. It is important for the vertical tubes 7 and 8 in question to be freely movable in the directions of the double arrows over their entire length notwithstanding the distribution and header lines to be described in detail below, in order to achieve the purpose of the invention. (A movable section of the tubes as a consequence of thermal expansion with means of compensation is not meant here).

In the example shown, the tubes 7 open into a bottom distribution line 13 that is connected to a boiler drum through a downpipe (not shown), and into an upper header line 14 that is connected in the same way through a riser to the boiler. The tubes 8 are connected in the same way to a lower distribution line 15 and an upper header line 16 and are connected through a downpipe and a riser to the boiler drum.

The upper horizontal header lines 14 and 16, parallel to one another, together with the tubes 7 and 8 suspended on them, and the lower, likewise parallel horizontal distribution lines 13 and 15, form a unit that is movable in the longitudinal directions of the pipes (cf. arrow S in FIG. 1).

Figure 2:
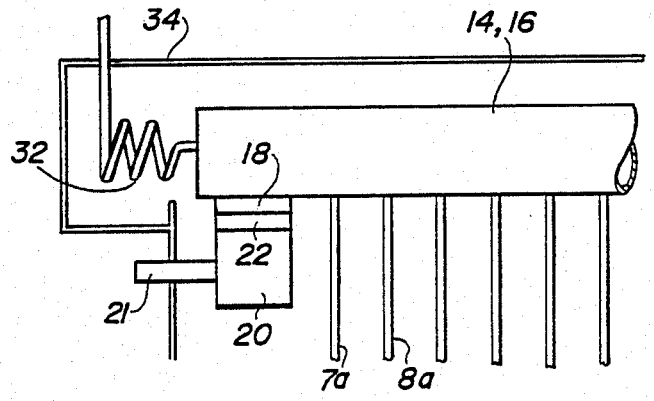
FIG. 2 is an enlarged cross sectional view of one end of a top header line of a row of tubes with a device for lifting this one end of the header line.
Figure 3:
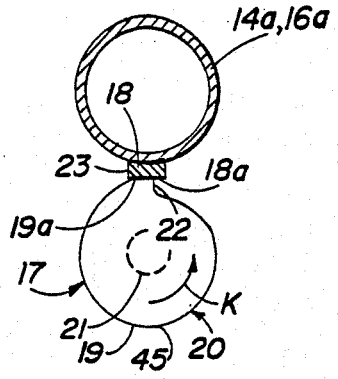
FIG. 3 is an enlarged sectional view of a device for lifting the ends of the header line of FIG. 2.

In the example illustrated, the two ends 14*a* and 16*a* of each header line 14 and 16 are supported on a lifting and supporting device with the general reference symbol 17 (FIG. 3). For this purpose, the ends of the lines 14*a* and 16*a* have a shoulder 18 at their bottom sections, which extends between the face 14*b* and 16*b* of the line 14 and 16 and the first tube 7*b* and 8*b* adjacent to this wall. This shoulder 18 preferably has a slightly concave arched bottom 18*a* (FIGS. 2 and 3). Against it rests the correspondingly arched section 19*a* of the circumference 19 of a cam plate 20, that with its drive represents the lifting device of the two ends of the lines 14*a* and 16*a* of each header line. The cam plate 20 can preferably be actuated from the outside of the heat exchanger by rotating its carrying shaft 21. The circumference 19 of the cam plate forms an offset or a shoulder 20. During the rotation of the cam plate 20 in the direction of the arrow K in FIGJ. 3, the header lines 14 and 16 are lifted until the moment when the edge 23 of the offset of of the shoulder 22 slips off of the shoulder 24 of the section 19*a* of the cam plate 20 with the largest radius. This sliding off produces an abrupt drop of the header line 14 and 16 since the lifting and support device 17 is operated synchronously at both ends of the lines 14 and 16. The thickness of the shoulder 18 is larger than that of the offset or of the shoulder 22, so that the shoulder 18 rests on the circumference 19 of the cam plate 20 directly next to or in the vicinity of the offset or of the shoulder 22.

The rotary motion of the cam plate 20 can be repeated as often as desired; the tubes 7 and 8 are kept in the raised position by stopping the cam plate in a position as shown in FIG. 2 or just before that.

Preferably, all of the cam plates on one side of the exchanger are moved by a common rod simultaneously with the cam plates at the other ends of the lines.

Figure 6:
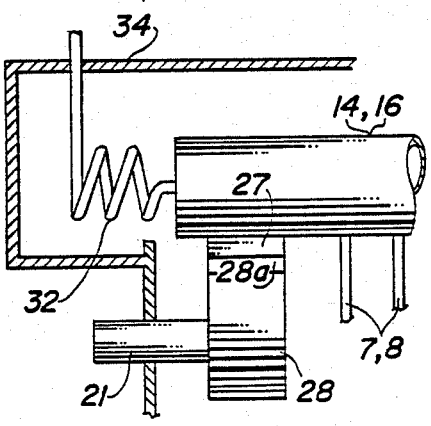
FIG. 6 is an enlarged sectional view of another form of embodiment of the device for lifting the tubes.

In the form of embodiment of FIG. 6, a crossbar 27 is provided for the lines 14 and 16 of one side of the exchanger. This can be lifted while lying horizontally at each end 27*a* and 27*b* by a cam plate of the type of the cam plate 20. Each of these cam plates of the type of the cam plate 20 and 31 at the height of the cam plates, so that the lifting of the crossbars and thus of the tubes 7 and 8 can occur appropriately here also. The header lines 14 and 16 are fastened to the crossbars.

Figure 5A:
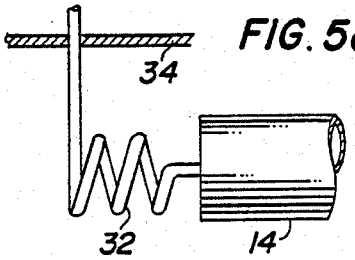
FIGS. 5*a* and 5*b* are enlarged sectional views of the passage of a branch of the header boxes or feeder boxes through the wall or cover of the heat exchanger.
Figure 5B:
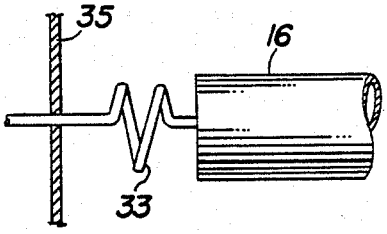

The header lines 14 and 16 can be connected to the boiler drum, not illustrated, as shown in FIG. 5, through extendable and retractable compensating pipes 32 and 33, which in turn pass through the wall or the cover 34 and 35 of the boiler or of the heat exchanger. Either the lines 32 and 33 have corresponding cross sections at both ends of the lines 14 and 16 or are arranged into several.

Figure 4B:
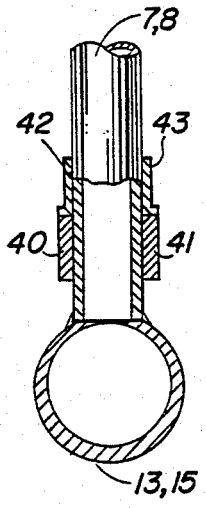
FIGS. 4*a* and 4*b* are enlarged sectional views of the bottom end of a tube and a stationary stop which the tube end strikes, with the tube being in its raised initial position in the illustration a, while the lower end of the tube rests on the stationary stop in the illustration b.
Figure 4A:
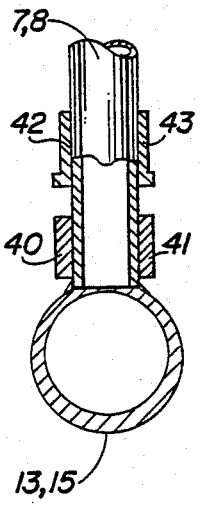
Figure 7:
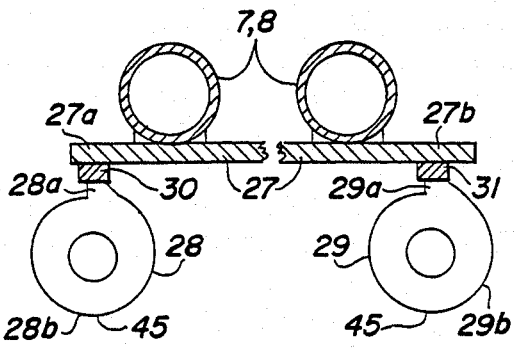
FIG. 7 is a partial side view of the embodiment of FIG. 6.

Crossbars 40 and 41 that can be mutually reinforced in a suitable way, extend between the side walls 5 of the boiler or heat exchanger at the level of the lower ends of each of the tubes 7 and 8 and thus just above the distribution lines 13 and 15. The tubes 7 and 8 have shoulders 42 and 43 above these crossbars in their immediate vicinity. When the tubes 7 and 8 are lifted, a separation as shown in FIG. 4*a* is produced between the shoulders 42 and 43 and the crossbars 40 and 41 that is smaller than the height of the offset or of the shoulder 22 on the circumference 19 of the cam plate 20. When the shoulder 22 of the shoulder 18 falls off of the offset or of the shoulder 22 of the cam plate 20, the shoulders 42 and 43 strike the crossbars 40 and 41. In this form of embodiment, the shoulder 18 or the shoulders 30 and 31 of FIGS. 6 and 7 do not lie in the vicinity of the offset or of the shoulder 22 (FIG. 3) or 28*a* and 29*a* (FIG. 7), but approximately at 45 on the circumference 19 or 28*b* and 29*b* of the cam plate, i.e., at points with a a larger radius, so that the tubes 7 and 8, after the shoulder 18, 30 and 31 slips off of the offset or the shoulder 22, 28*a* and 29*a* are again raised until the tubes 7 and 8 are suspended and held by their top ends at the circumference of the cam plate.

Instead of the crossbars 40 and 41 and the shoulders 42 and 43, a stop can also be provided beneath the distribution lines 13 and 15, which is preferred when inverted tubes or rows of tubes and tube walls are used in departure from the illustrated arrangement of tubes and of the meandering path of the gases.

FIG. 1 indicates in broken lines that instead of the wall 10 and the bottom 1, hoppers 50 can be provided with each hopper being associated with two adjacent gaps 11; any other design and arrangement of the hoppers can be chosen.

A cam plate like the plate 20 or the plate 28 operates by the principle of a wedge that is placed on an endless rotating chain. It is therefore possible, instead of the individual cam plates or the common cam plates for a row of tubes, to choose an endless rotating chain that carries wedges at the separation of the tubes or at the separation of the ends of the crossbars 27 according to FIGS. 6 and 7 whose diagonal wedge face points upward toward the tubes or toward the crossbar. During the rotation of the chain, the wedges on the carrying run raise the tubes and go back again into their operating position on the lower strand of the chain. In this design, additional support elements are provided for the tubes or the crossbars, on which these parts rest until the wedges cause another lifting of the tubes or of the crossbars. The shoulders on the tubes 14*a* and 16*a* or at the ends 27*a* and 28*a* of the crossbars in this case can likewise have a corresponding wedge shape, and any other suitable traction mechanism can be used instead of the chain to which the wedges, prefereably guided in shaped rails, can be attached.

Figure 8:
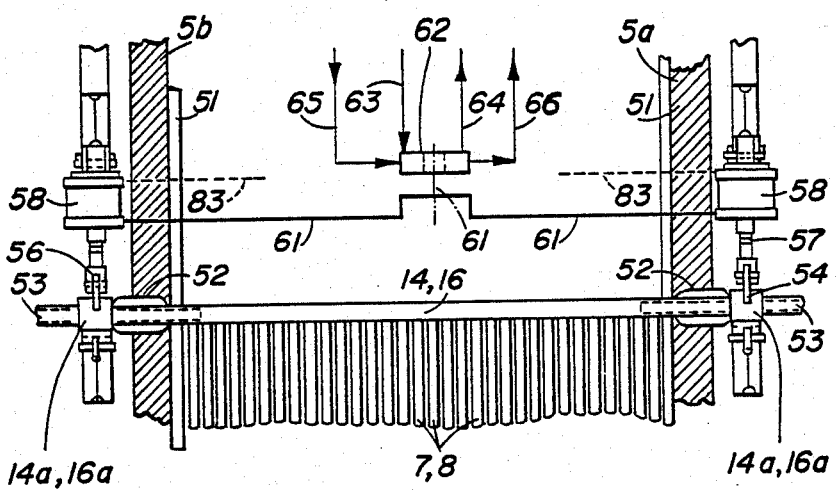
FIG. 8 is a sectional view of the upper section of a heat exchanger with an upper header tube, with exchanger tubes suspended on it, and as an alternative, the two lifting devices and catching devices on the ends of the header tube.
Figure 9:
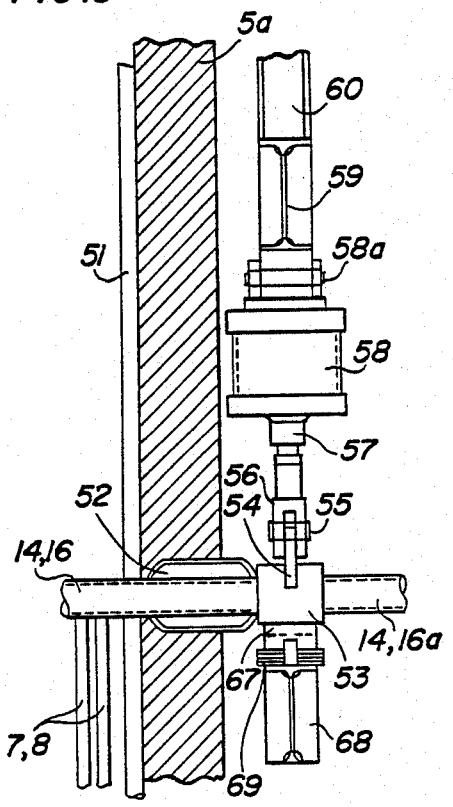
FIGS. 9 and 10 are respective front and side sectional views of the lifting and catching device at the ends of the header tube, on a larger scale than FIG. 8.
Figure 10:
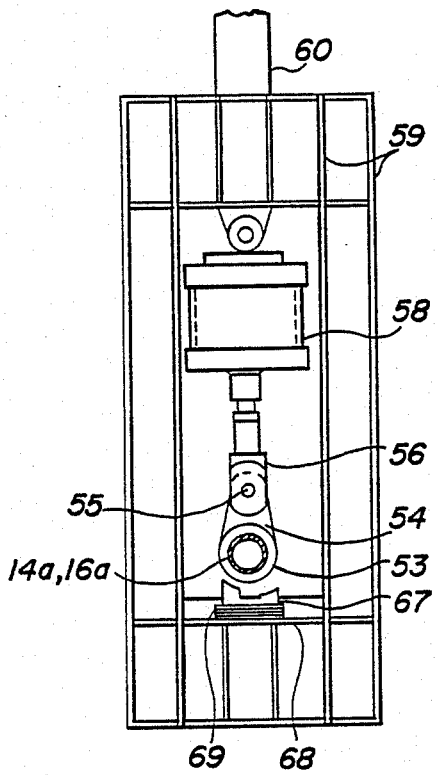
Figure 12:
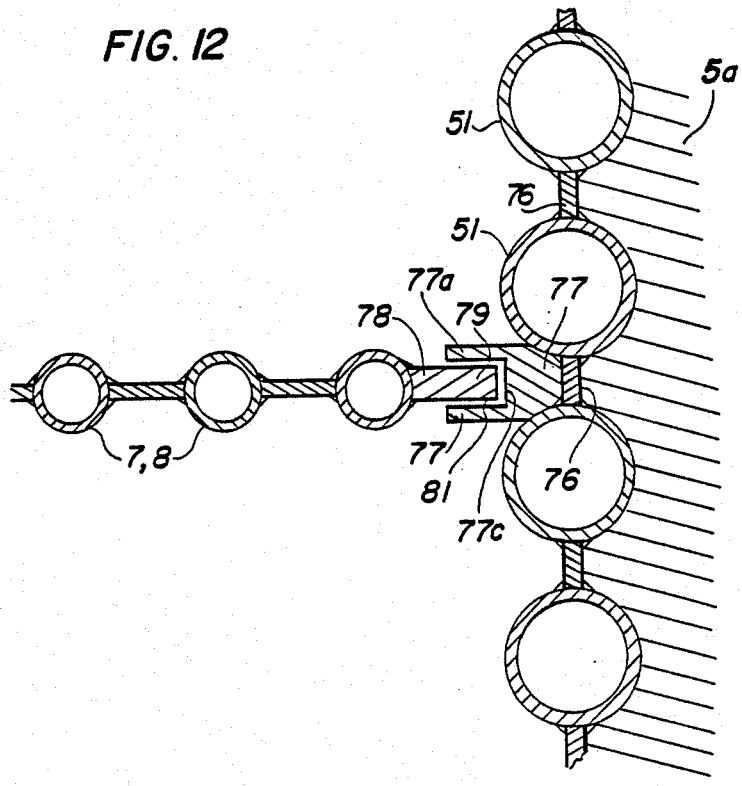
FIGS. 12 and 13 are respective partial sectional and elevational views of a device for the additional sideswing of a row of tubes.
Figure 13:
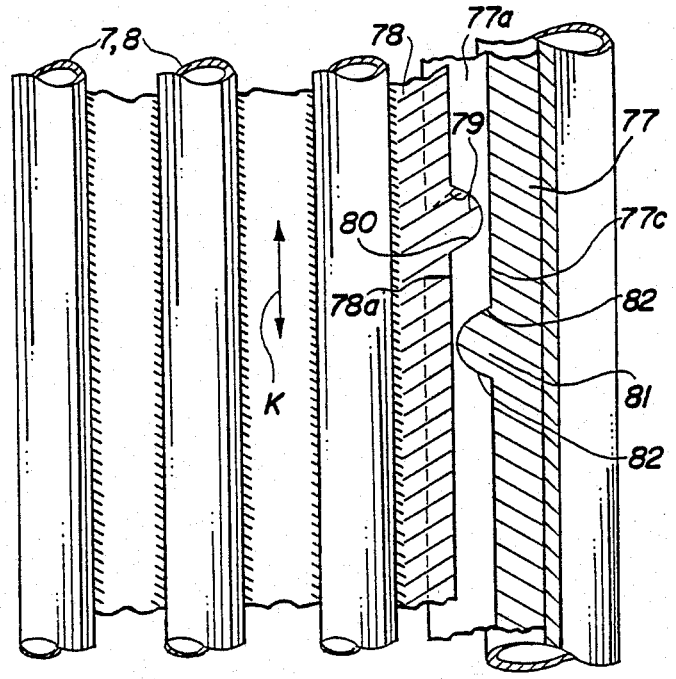

In the form of embodiment according to FIGS. 8, 12 and 13, the two side walls 5*a* and 5*b* of the waste heat boiler are lined with adjacent finned tubes 51 that form a continuous wall. These finned tubes and the side walls 5*a* and 5*b* are penetrated by the header tubes 14 and 16 for which they pass through a pipe connector 52. The ends 14*a* and 16*a* of the header tubes extending out of the side walls 5*a* and 5*b* have a collar 53 that has a supporting rib 54. This is connected to pivot by a pin 55 to a fork 56, which in turn is connected to the piston rod 57 of a suspended pneumatic piston cylinder unit 58, which hangs from a traverse 60 or the like by suitable means 59, for example. The two piston cylinder units 58 on each side of the waste heat boiler, i.e., outside of the side walls 5*a*, 5*b* of the boiler, are connected to one another through a common line 61 that leads to a valve 62, whose supply and discharge lines have the reference symbols 63, 64. This valve 62 determines the pressure ratios in the piston cylinder unit 58 for lifting or lowering the header tubes 14, 16 and the tubes 7, 8 suspended on them, and is controlled hydraulically, pneumatically, or electrically through lines 65, 66. In this way, the header tube 14, 16 of each row of tubes consisting of the tubes 7, 8 can be raised uniformly, and likewise can be lowered uniformly.

Figure 11:
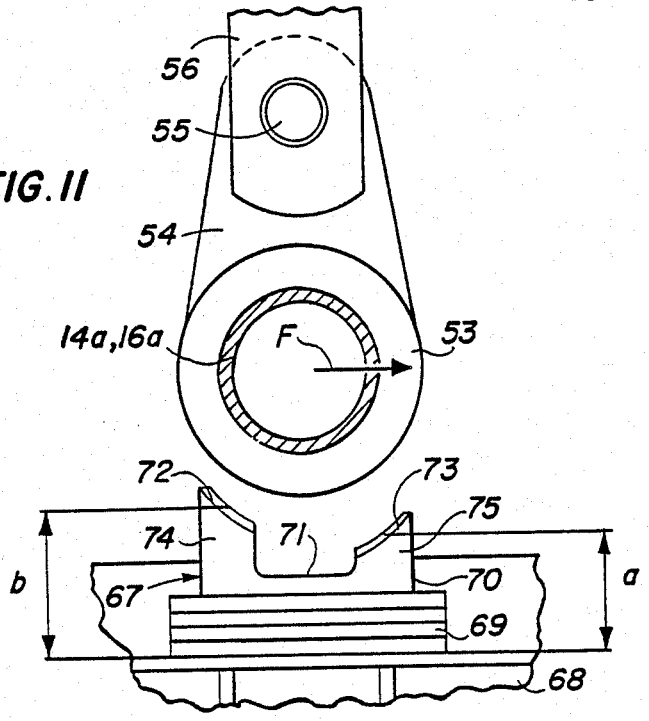
FIG. 11 is a partial front elevational and sectional view of the catching device for the ends of the header tube and the means of connection between these ends and the piston cylinder of the lifting device, on a scale larger than FIG. 10.

The catching device for the collar 53 gives the general reference symbol 67 and the ends of the tubes 14*a*, 16*a* are placed at the level of the collar 53, below it. This is attahced to a suitable crossbar 68 and has several layes of superimposed metallic orother type of plates 69. These hold a yoke 70 that is formed from a central section 71 and two jaws 72, 73. The jaws on the arms 74, 75 of the yoke have a curvature at their concave tops sloped toward one another that matches the curvature of the circumference of the collar 53. The two jaws are displaced in height from the plates 69 and the crossbar 68. Thus, the jaw 73 has a central height "a" from the crossbar 68, while the jaw 72 has a central height "b" that is significantly larger than the height "a". When the collar 53 strikes the yoke 70 when the header tubes 14, 16 drop, the row of tubes with the header tubes 14, 16 is given a sudden lateral motion in the direction of the arrow F in FIG. 11 in addition to striking the yoke 70.

The pivot suspension of the rib 54 on the piston cylinder unit 58, which can additionally be mounted to pivot through a linkage 58*a*, serves this purpose. When the header line 14 and 16 is lifted to its upper position by the piston cylinder unit 58, the row of tubes pivots with the tubes 7 and 8 back into the starting position shown in FIG. 11 in which the collar 53 stands symmetrically above the yoke 70.

The header lines 14 and 16 with the tubes 7 and 8 suspended on them are subject to the action of gravity when the piston cylinder unit is depressurized, so that a sudden lowering of the parts is produced. If this lowering is to be additionally accelerated, the piston cylinder units 58 are connected to the lines 83 when the counterline 61 is depressurized.

So that not only the upper section of the rows of tubes consisting of the tubes 7 and 8 and the upper header lines 14 and 16 are given a sudden lateral displacement when the rows of tubes are lowered, when the piston cylinder units 58 are depressurized, one or more devices can be provided along the length of the rows of tubes consisting of the tubes 7 and 8 as shown in FIGS. 12 and 13. The fins 76 of the tubes 51 (cf. also FIG. 8), which line the wall 5*a*, have a continuous rib or fin 77 over the length of the tubes 7 and 8 for this purpose. (Only one rib or fin 77 for one row of tubes is shown in FIG. 12. Such a rib or fin is associated with each row of tubes). Opposite this rib or fin, the tubes 7 and 8 adjacent to the tube wall 5*a* also has a rib or a fin 78 that is continuous over the length of this tube. The rib or fin 77 surrounds the edge 78*a* of the rib or fin 78 with its edges 77*a* and 77*b* with these edges having a slip fit on one another. The rib or fin 78 at its edge 78*a* has profiled projections 79 at uniform longitudinal distances that have the wedge surfaces 80. The edge 77*c* of the rib or fin 77 carries shoulders 81 with wedge surfaces 82 at the same interval as the projections 79, off of which the diagonal wedge faces 80 of the profiled projection 79 slip when the row of tubes consisting of the tubes 7 and 8 is raised or lowered with the header line 14 and 16 in the direction of the arrow K (FIG. 12). The tubes are suddenly displaced laterally parallel to one another in the direction of the double arrows K by the projections 79 and the shoulders 81.

The tube wall 5*b* opposite the tube wall 5*a* (cf. FIG. 8) is designed to conform to the tubes 7 and 8 adjacent to this wall.

What is claimed is:

1. A heat exchanger device comprising a housing having an inlet on one end and an outlet at the opposite end, an upper header support in said housing, a plurality of rows of tubes supported from said upper header and being connected to said header, a lower header in said housing, a plurality of rows of tubes each including a row extending between the rows suspended from the upper header, said heat exchanger forming a flow path between the rows of two suspended tubes at the upper header and the rows of tubes connected to the lower header and a tube row lifting menas including a member engaging with one of said header to move said header and associated row of tubes upwardly and downwardly.

2. A tube heat transferring device according to claim 1 wherein said moving device comprises a rotatable cam positioned below said header and engaging with said header to raise and lower the tubes of said row.

3. A tube heat transfer device comprising at least one row of vertically extending laterally arranged tubes each having a lower horizontal distributor and an upper horizontal header into which the tubes connect, and movable member means engaging said row for raising and lowering said row of tubes, said tubes of said row tubes includes a lower area having a shoulder extending outwardly from said tube row and moveable there with a fixed stop member in the path of the movement of said shoulder and engagable with said shoulder, said movable member means acting to move said row of tubes upwardly and downwardly by a predetermined distance wherein said stop interrupts the downward movement of the row of tubes when said stop engages said shoulder.

4. A tube heat transfer device comprising a heat exchanger having at least one row of vertically extending laterally arranged tubes each having a lower horizontal distributor and an upper horizontal header into which they connect, and movable member means engaging said row for raising and suddenly lowering said rows said movable member comprising a fluid pressure operated piston cylinder connected to the said upper header tube for raising said tube row.

5. A device according to claim 4 including means associated with said pressure operated piston and cylinder combination to permit dropping of said row of tubes after it has been raised.

6. A device according to claim 4 wherein said horizontal header tubes are provided with a collar at their end extending out of said heat exchanger said movable member comprising a lifting device connected to said collar.

7. A device according to claim 6 wherein said device includes a yoke forming an arched shell conforming to the end of said horizontal header tubes.

8. A device according to claim 3 wherein said movable member comprises a lifting member and support of each row of tubes including spaced apart jaw element engagable with respective sides of the lower horizontal distributor of said tube row.

9. A device according to claim 4 wherein said movable member includes a lower engagement part which is pivotably connected to a piston rod of said piston by a pivot pin held by said piston rod and engaging said lower engagement part.

10. A device according to claim 4 wherein said tube row include a plurality of vertically arranges tubes each having fins bridging the space in between with the two adjacent tubes in a row having means that displaces the row laterally during the movement upwardly an downwardly.

11. A tube heat transferring device according to claim 10 including means for displacing the tube row laterally during its upward and downward movement comprising an inclined surface on one of the adjacent set of tubes in a row forming a projection which extends perpendicularly through the axis of said tubes.

12. A tube heat transferring device according to claim 11 wherein two of the outer tubes of each row of tubes of an adjacent heat exchanger wall are provided with longitudinal fins which slide one upon the other said fins having a laterally sloping surface the other adjacent tube having a shoulder with the two engaging the other and is displaced laterally during the upward and downward movement thereof.

* * * * *